United States Patent [19]

Kunishi

[11] Patent Number: 4,992,831

[45] Date of Patent: Feb. 12, 1991

[54] IMAGE FORMING APPARATUS WITH PLURAL DEVELOPING DEVICES

[75] Inventor: Tsuyoshi Kunishi, Yokohama, Japan

[73] Assignee: Canon Kabushiki Kaisha, Tokyo, Japan

[21] Appl. No.: 145,594

[22] Filed: Jan. 19, 1988

[30] Foreign Application Priority Data

Jan. 19, 1987 [JP] Japan ..... 62-9448
Jan. 19, 1987 [JP] Japan ..... 62-9449
Jan. 19, 1987 [JP] Japan ..... 62-9451

[51] Int. Cl.[5] ..... G03G 15/06

[52] U.S. Cl. ..... 355/245; 355/272; 355/273; 355/319

[58] Field of Search ..... 355/14 TR, 14 D, 3 TR, 355/4, 326, 327, 328, 245, 319, 273, 274, 272, 271; 430/126, 45

[56] References Cited

U.S. PATENT DOCUMENTS

| | | | |
|---|---|---|---|
| 3,267,840 | 8/1966 | Honma et al. | 101/1 |
| 4,187,774 | 2/1980 | Iwasa et al. | 101/1 |
| 4,251,154 | 2/1981 | Russel | 355/4 |
| 4,539,281 | 9/1985 | Tanaka et al. | 430/45 |
| 4,572,651 | 2/1986 | Komatsu et al. | 430/45 X |
| 4,609,280 | 9/1986 | Queener | 355/3 |

FOREIGN PATENT DOCUMENTS 2811076 9/1978 Fed. Rep. of Germany .

*Primary Examiner*—Fred L. Bralin
*Assistant Examiner*—Robert Beatty
*Attorney, Agent, or Firm*—Fitzpatrick, Cella, Harper & Scinto

[57] ABSTRACT

In an image forming apparatus having two developers, toner deposition parameters in the second developing device are larger than the first developing device. Here, the toner deposition parameter is represented by an amount of electric charge of the toner particles, an amount of developer particles constituting a foggy background, an amount of carrier particles deposited on the image bearing member, or any combination of these parameters. The amount of the fog developer particles is determined first by a ratio of the total area occupied by the fog developer particles to the entire background area, second by a ratio of the fog developer particles having large particle sizes to the entire fog developer particles, third by a particle size at which a number of the fog developer particles accumulated in the large size side of a number/particle size distribution graph reaches a predetermined percentage to the entie number of fog developer particles, and fourth by a number of fog developer particles per unit area. By this arrangement of the developing devices, failure of transfer material separation from the image bearing member and retransfer of the image can be avoided when the toner image formed by the second developer is transferred.

15 Claims, 4 Drawing Sheets

IMAGE FORMING APPARATUS WITH PLURAL DEVELOPING DEVICES

FIELD OF THE INVENTION AND RELATED ART

The present invention relates to an image forming apparatus provided with a plurality of developing devices, wherein a process is executed plural times to one transfer material, including an image transferring operation for transferring toner images formed by plural developing devices onto the transfer material, a separating operation for separating the transfer material from an image bearing member particularly by a discharge separation method and an image fixing operation for fixing the toner image on the transfer material.

Referring to FIG. 1, there is shown an example of a conventional apparatus of such a type, wherein two image forming operations using two developing devices are performed to one transfer material. The device depicted will produce superimposed images, although those skilled in the art will recognize that the device may be adapted to produce duplex images. The image forming process is as follows. A surface of an image bearing member 10 such as a photosensitive drum or a dielectric member is uniformly charged by a primary charger 11, and then is exposed to image light 12 so that an electrostatic latent image is formed on the surface. The electrostatic latent image thus formed is developed by one of the developing devices 13 and 14 into a toner image, to which a transfer material 18 is closely contacted in an image transfer station, where an image transfer device 15 applies electric charge having the polarity opposite to that of the toner to the backside of the transfer material 18, whereby the toner image is transferred onto the transfer material 18 due to the electrostatic attraction force. Immediately after the image transfer process, a separation device 16 applies AC corona or the like to the backside of transfer material 18 to electrically discharge the transfer material 18 to permit the transfer material 18 to be separated from the image bearing member 10. The transfer material 18 which has been subjected to the first transfer and separation steps is transported to an image fixing device 19, where the toner image is fixed, where after the transfer material 18 is conveyed in the direction indicated by an arrow a and, in dependence on the position of pawl 20, is accommodated in a refeeding device 21. Meanwhile, image bearing member 10 is cleared of residual toner at cleaning station 17, and, after a number, preset by an operator, of the transfer materials have been subjected to the first image formation and have been stacked on the refeeding device 21, the transfer material 18 is fed out in the direction indicated by an arrow c by the refeeding device 21 one by one. The refed transfer material is subjected to the second toner image transfer operation and the second separating operation from the image bearing member 10. The second toner image is the one developed by the other developing device, that is, the developing device not used in the first image formation. The transfer material 18 is then fed from the apparatus as indicated at arrow b.

By the first image fixing step, the transfer material 18 is more or less curled as shown in FIG. 2. As is known, in a discharge type separating method wherein the transfer material is separated from image bearing member using the elasticity of the transfer material, the separating action is largely dependent on the presence or absence or degree of the curling of the transfer material. For example, when the leading portion of the transfer material 18 is upwardly curled to tend to follow the curved surface of the image bearing member 10, the resilient force for separating the transfer material 18 from the image bearing member 10 surface is not sufficiently large. This results in inconveniences in the conveyance of the transfer material 18 and in the image quality, more particularly, the unsatisfactory separation and retransfer or the like. The "retransfer" is a phenomenon in which a toner image transferred from the image bearing member onto the transfer material 18 is transferred back to the image bearing member, or in which the toner image thus transferred back is again transferred to the transfer material 18 at a position different from the original position. Particularly in the discharge separation method, it has been recognized that the developed image is disturbed, in addition to the inconvenience of unsatisfactory separation of the transfer material.

It has been proposed in order to solve this problem that a curl correcting roller is used for removing the curl itself. However, it has been found that this roller is not effective when the amount of curl varies greatly.

In any event, when a transfer material is subjected to an image fixing operation, and thereafter is subjected to another image transfer and separating operation (discharge separation or electrostatic separation) as in the case of superimposing or duplex image formation, the separation becomes extremely unsatisfactory, resulting in improper separation or retransfer occurring frequently, and therefore, the conveyance of the transfer material and the image quality are extremely deteriorated.

SUMMARY OF THE INVENTION

Accordingly, it is a principal object of the present invention to provide a solution to the above described problems.

It is another object of the present invention to provide an image forming apparatus such as a printer, a copying machine or a facsimile machine, provided with plural developing devices, wherein good images can be stably provided.

It is a further object of the present invention to provide an image forming apparatus wherein the developed image can be correctly transferred onto a transfer material with stabilized conveyance of the transfer material.

The inventor of this application has made various investigations and experiments to provide a solution to the above-noted problems, and has found that although the problems are with image transfer or separation, they can be solved by making the developing condition or conditions by the second developing device (the developing device for forming a developed image which is to be transferred onto a transfer material which has been at least once subjected to the image fixing operation) different from that of the first developing device.

More particularly, the inventor has particularly noted "a developer deposition parameter" which relates to a tendency of the developer depositing onto the image area or non-image area (background) of an image bearing member. The developer deposition parameter varies, when the developer mainly consists of toner, an amount of charge of the toner or a degree of magnetization of the toner to be deposited onto the image bearing member; and, when the developer mainly consists of toner and carrier, an amount of deposition of the carrier onto the image bearing member, in addition to the toner. The deposition parameter contains an amount of fog developer which constitutes a foggy background of the image.

Firstly, the inventor has found that the transfer material separation property is greatly dependent on the state of deposition of the developer in the background area (fog), that is the developer deposited on the white area of the image bearing member surface during the developing process. Here, the white area includes the white area of the original to be copied or a white area formed by an erasing exposure step or the like. In the case of a reverse development as in the case of a laser beam printer, the white area is the area where the toner is not supposed to be deposited. Further investigation has revealed that there exists the following relation between the state of deposition of the fog developer in the white background area on the image bearing member surface and the separating performance of the discharge separation method.

More particularly, when a first developing device for forming a first image is compared with a second developing device for forming a second image to be formed after the first image is fixed, the conventional apparatus or the apparatus involving the above described problem, is provided with the second developing device in which the fog is hardly formed or is less than the first developing device. In such an apparatus, unsatisfactory separation and/or retransfer have occurred. It has been found, however, that by making the second developing device easier to produce fog than the first developing device, the unsatisfactory separation is prevented, and the retransfer is greatly reduced.

The state of deposition of the fog developer in the background area is different if the structure of the developing device and/or the developer is different. Therefore, when different types of developing devices are employed, the separation properties in the discharge separation method are greatly different. With a decrease in the deposition of the fog developer, unsatisfactory separation and retransfer increases.

The present invention is based on the finding described above.

According to an embodiment of the present invention, there is provided an image forming apparatus having a first and second developing devices wherein a toner image formed on an image bearing member by the first developing device is electrostatically transferred onto a transfer material; the transfer material is separated from the image bearing member by a discharge separation method; the toner image is fixed on the transfer material by an image fixing device, a second image formed on the image bearing member by the second developing device is electrostatically transferred onto the same transfer material; the transfer material is separated from the image bearing member again by the discharge separation method; and then the second toner image is fixed by the fixing, machine, characterized in that the amount of fog developer by the second developing device is larger than the amount by the first developing device.

The amount of the fog developer is quite stabilized in the developing devices.

The amounts of developer which cause fog, i.e. by fog developer, are compared with respect to ratios of respective total areas occupied by the fog developer particles to the entire background areas; ratios of fog developer particles having large particle sizes to the entire fog developer particles in the respective background areas; particle sizes at which respective numbers of the fog developer particles accumulated in the large size side of a number/particle size distribution graph reaches a predetermined percentage (50% or 10%, for example) to the entire number of fog developer particles; or numbers of fog developer particles per unit areas, respectively.

According to this embodiment of the present invention, the transfer material separation can be performed satisfactorily, and the retransfer can be prevented, so that the transfer material can be stably conveyed, and the image quality is assured.

According to another embodiment of the present invention, the deposition parameter is an amount of carrier particles deposited on the image bearing member. In this embodiment, the inventor has particularly noted the carrier particles, not the toner, slightly deposited on the white background area of the image bearing member during the developing process. Here, the white background area includes the white background of an original and a white area formed by erasing exposure or the like. The inventor has found that the amount of the deposited carrier particles is greatly influential to the transfer material separation or retransfer of the image. This embodiment provides an image forming apparatus including first and second developing devices, wherein a toner image formed by the first developing device is transferred onto a transfer material, which is then separated from the image bearing member and is subjected to an image fixing operation; and then a second toner image formed by the second developing device is transferred onto the same transfer material, which is then separated from the image bearing member, characterized in that the amount of carrier particles deposited on the surface of the image bearing member when the image is developed by the second developing device is larger than that of the amount of carrier particles by the first developing device.

The first developing device may be of a type using two component developer or a type using one component developer.

According to a further embodiment of the present invention, the deposition parameter is the amount of charge of the toner particles. In this embodiment, the inventor has particularly noted the relationship between the order of operations of the first and second developing devices and the amounts of charge of the toner particles of the respective developing devices. This embodiment provides an image forming apparatus including first and second developing devices wherein a toner image formed by the first developing device is transferred onto a transfer material, which is then separated from the image bearing member and is subjected to an image fixing operation; and then, a second toner image formed by the second developing device is further transferred onto the same transfer material, which is then separated from the image bearing member and is subjected to an image, fixing operation, characterized in that the amount of charge of the toner particles in the second developing device is larger than that in the first developing device.

This embodiment is based on the finding that the frequency of occurrence of the above described retransfer is greatly dependent on the difference in the amounts of charge of toners in the first and second developing devices. It has been revealed that in the conventional machines, the amount of toner in the second developing device is smaller than that in the first developing device, and therefore, the retransfer easily occurs at the time of the transfer material being separated. Further, if the transfer material 18 is upwardly curled, the retransfer readily occurs depending on the change in the ambient condition or the amount of moisture of the transfer material.

According to this embodiment, the inconveniences have been eliminated.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
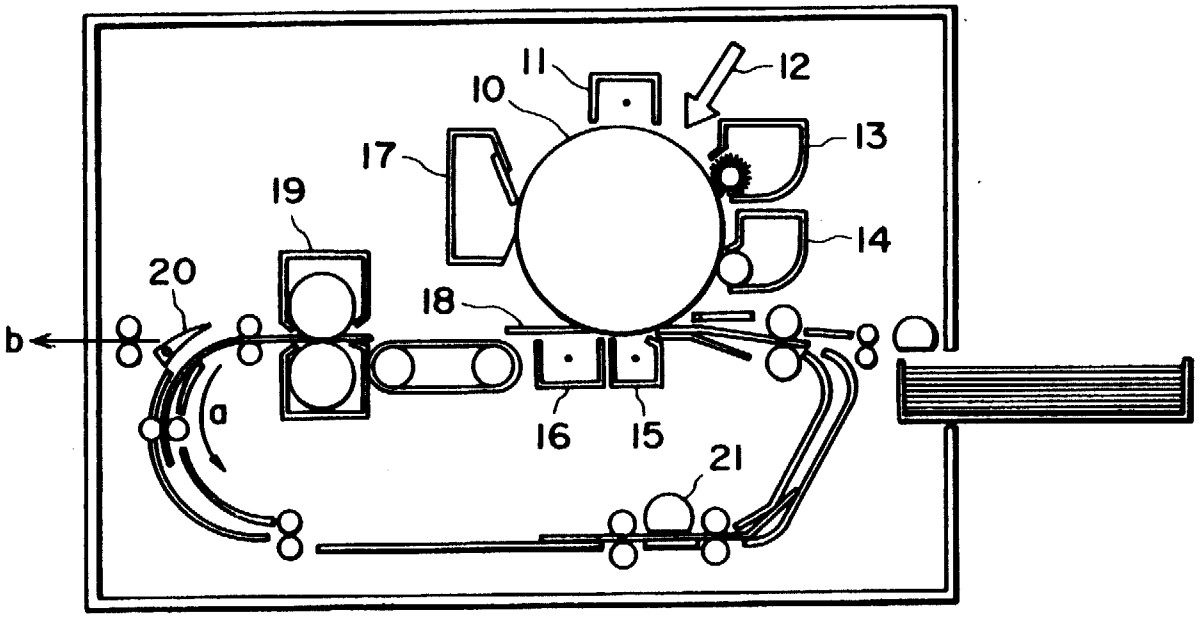
FIG. 1 is a somewhat schematic sectional view of an image forming apparatus according to an embodiment of the present invention.
Figure 2:
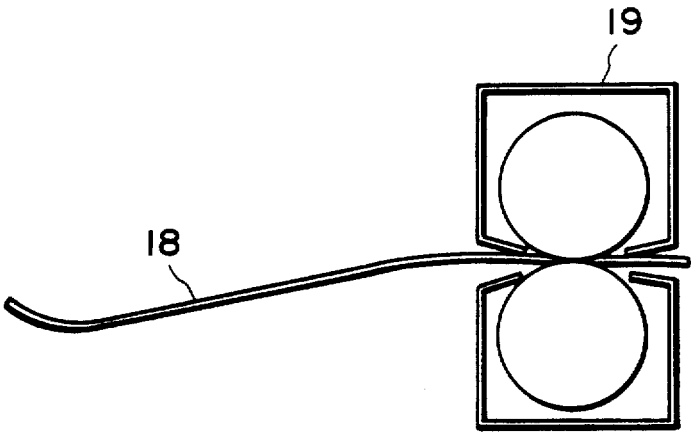
FIG. 2 is a sectional view of an image fixing device illustrating curl of the transfer material.

Referring to FIG. 1, there is shown an image forming apparatus according to an embodiment of the present invention. The apparatus includes a developing device 13 (second developing device) of a magnetic brush developing type using a two component developer containing carrier particles or the like, and another developing device 14 first developing device) of a non-contact developing type using a one component developer not containing carrier particles. Since those developing devices are different in the developing process, the state of deposition of a small amount of developer deposited in the white area of a surface of an image bearing member is different when the toner image is formed. The deposition of the toner constitutes a foggy background. In this embodiment, the number of fog developer particles per unit area formed by the developing device 14 is smaller than the number of fog developer particles per unit area formed by the developing device 13.

The toner image formed on the image bearing member 10 surface by the developing device 13 was observed by a microscope, and the number of fog developer particles per unit area was counted to be 390/mm$^2$; in the developing device 14, it was 165/mm$^2$. It is apparent that the number in the developing device 14 is smaller than the number in the developing device 13.

Figure 3:
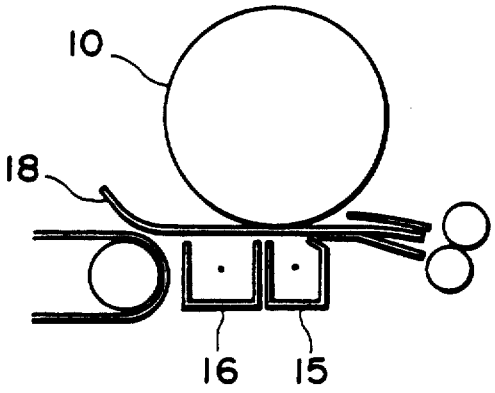
FIG. 3 is a sectional view of a neighborhood of a transfer device, illustrating a relationship between a curvature of the surface of the image bearing member and a curvature of the curl of the transfer material when the transfer material is curled toward the image bearing member

In the image forming apparatus according to this embodiment, when the toner image formed by the developing device 13 and the toner image formed by the developing device 14 are transferred onto one and the same transfer material 18, the image forming operation is performed in the following sequence. After a first electrostatic latent image formed through a known process, the latent image is developed necessarily by the developing device 14 by which the number of fog developer particles per unit area is smaller. Thereafter, the toner image is transferred onto the transfer material 18 and is separated from the image bearing member, and then is subjected to an image fixing operation. The transfer material 18 is stacked on a refeeding device 21. The image transfer here is an electrostatic image transfer, and the separation is performed by a discharge separation method, in this embodiment. Of course, the first electrostatic latent image is the one which the operator designates as to be developed by the developer contained in the developing device 14. A number, preset by the operator, of the transfer materials 18 having received the first images, are stacked on the refeeding device 21, the transfer material 18 is fed out of the refeeding device 21 one by one in the direction indicated by an arrow c. The transfer material 18 receives a second toner image and is separated from the image bearing member 10. The second toner image is necessarily formed by the developing device 13 in which the number of fog developer particles per unit area is larger. In the first separating step, the transfer material 18 has never been subjected to the image fixing treatment, and therefore, it does not involve such a curling that adversely affects the separation. So, even if the toner image is formed by the developing device 14 by which the number of fog developer particles per unit area is smaller, the transfer material 18 can be easily separated from the image bearing member without trouble such as improper separation or image retransfer. In the second separating step, the transfer material 18 is relatively largely curled as a result of the first image fixing treatment (see FIG. 3). However, the toner image is formed by the developing device 13 by which the number of fog developer particles per unit area is large, and therefore, the transfer material 18 can be easily separated without improper separation or image retransfer. Table 1 shows experimental results regarding frequencies of occurrences of improper separation and image retransfer in a conventional apparatus wherein the toner image is first formed by a developing device by which the number of fog developer particles per unit area is larger and an apparatus according to the present embodiment.

TABLE 1

| | frequency of improper separation occurrences | frequency of retransfer occurrences |
|---|---|---|
| Embodiment 1 | 0% | 0% |
| Conventional | 0.5% | 45% |

The results prove that the effects of the present invention are significant.

In this embodiment, the tendency of the fog occurrence is discriminated on the basis of the number density of the fog developer particles. However, this is only one method of discrimination. Other methods will be explained.

The developing operation starts from a developing apparatus by which a ratio of fog developer particles having large particle sizes to the entire fog developer particles is smaller. The ratio is, for example, a ratio of fog developer particles having particle sizes larger than 10 microns to the entire fog developer particles in the white area. If necessary, the limit of 10 microns may be replaced with 15 microns, 20 microns or larger.

Table 2 shows the results of experiments regarding frequencies of occurrences of improper separation and image retransfer in a conventional apparatus wherein the toner image is first formed by a developing device by which the ratio of the fog developer particles having particle sizes larger than 10 microns to the entire fog developer particles in the white area is larger, and an apparatus according to the present embodiment wherein the order is reversed. In this case, the numbers of the fog developer particles per unit area in the two apparatuses are comparable, more particularly, one of the numbers is not less than 0.5 but not more than 1.5 times the other number.

TABLE 2

| | frequency of improper separation occurrences | frequency of retransfer occurrences |
|---|---|---|
| Embodiment 2 | 0% | 0% |
| Conventional | 0.85% | 52% |

The results prove that the effects of the present embodiment is significant.

The ratios of the fog developer particles having particle sizes larger than 10 microns to the entire fog developer particles in the developing devices 13 and 14, were 46% and 35%, respectively.

Figure 6:
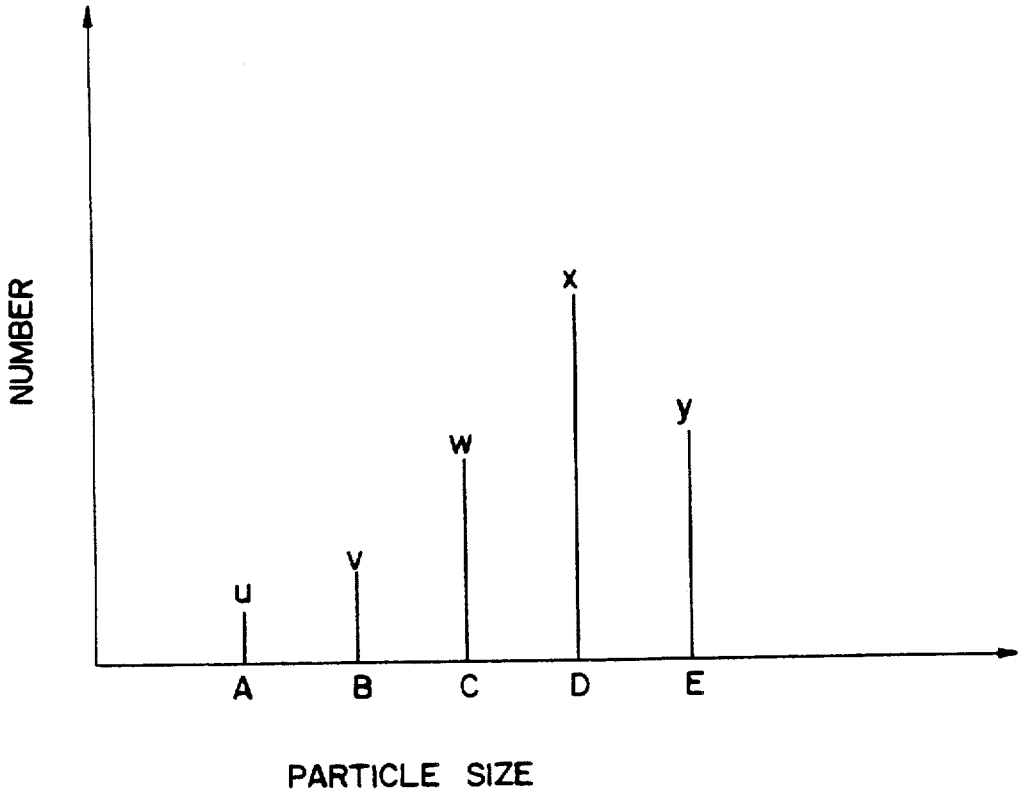
FIG. 6 is a graph showing an illustrative number/particle size distribution.

Another method of discrimination will be described. In this method, a number/particle size distribution is first determined. The distribution may be a histogram as shown in FIG. 6 in which the abscissa indicates the particle size of the toner and the ordinate indicates the number of toner particles having a particular particle size. For example, a toner contains u particles of size A microns, or w particles of size C microns, etc. The particle size at which the number of the fog developer particles accumulated in the large size side of a number/particle size distribution graph sides reaches a predetermined percentage (50% in this embodiment) to the number of whole fog developer particles, is then determined. With reference to FIG. 6, if $x+y$ is 50% of $u+v+w+x+y$, then particle size D is the "particle size at which the number of the fog developer particles accumulated in the large size side of a number/particle size distribution graph reaches a predetermined percentage". The developing operation starts from the developing device by which the thus determined particle size is smaller. The value of 50% is not limiting, and if necessary, it may be 30%, 20% or 10%.

Table 3 shows the results of experiments regarding frequencies of occurrences of improper separation and image retransfer in a conventional apparatus wherein the toner image is first formed by a developing device by which the particle size at which the number of the fog developer particles accumulated in the large size side of a number/particle size distribution graph reaches 10% to the number of whole fog developer particles was 15 microns, and then by the second developer wherein the particle size thus determined is 11 microns, and an apparatus according to this embodiment wherein the order is reversed.

TABLE 3

| | frequency of improper separation occurrences | frequency of retransfer occurrences |
|---|---|---|
| Embodiment 3 | 0% | 0% |
| Conventional | 0.6% | 48% |

The results prove that the effects of the present embodiment is significant.

The fourth method is dependent on the area occupied by the fog developer particles. More particularly, the developing operation starts from a developing device wherein a ratio of a total area occupied by the fog developer particles to the entire white area is smaller.

Table 4 shows the results of experiments regarding frequencies of occurrences of improper separation and image retransfer in a conventional apparatus wherein the toner image is first formed by a developing device 13 by which the ratio of the total area occupied by the fog developer particles to the entire white area is 2.5%, and then the second image is formed by a developing device 14 by which the ratio is 0.8%, and an apparatus according to the present embodiment wherein the order of developments is reversed.

TABLE 4

| | frequency of improper separation occurrences | frequency of retransfer occurrences |
|---|---|---|
| Embodiment 4 | 0% | 0% |
| Conventional | 0.8% | 62% |

The results prove that the effects of the present embodiment is significant.

As described in the foregoing, according to those embodiments of the present invention, the state of deposition of the fog developer particles is determined for each of the developing devices with respect to the number of fog developer particles, the ratio of large size toner particles, the number of larger toner particles or an area occupied by the toner, and the toner image formation is performed in the order from the less fog developing device. Although this is related to the developing operation, the effects appear in the transfer or separation operation wherein frequencies of the occurrences of improper separation and image retransfer can be reduced.

According to the present invention the frequencies of occurrences of improper separation and image retransfer can be greatly reduced if at least one of the above described parameters is satisfied.

However, it is preferable that two or more parameters are simultaneously satisfied in the developing devices. For example, the effects when the ambient conditions are varied are different between when the number relation is satisfied, and also the ratio of the large particle size developer is satisfied. More particularly, when the conditions are satisfied in plural discriminations, the stability against ambience variation is increased, as shown in Table 5.

TABLE 5

| Ambient temp. & humidity | 32.5° C., 90% | | 23° C., 50% | |
|---|---|---|---|---|
| | Frequency of improper separation occurrences | Frequency of retransfer occurrences | Frequency of improper separation occurrences | Frequency of retransfer occurrences |
| 1 | 0.5% | 24% | 0% | 0% |
| 2 | 0% | 0% | 0% | 0% |
| 3 | 2.1% | 74% | 0.6% | 42% |

1: Number only is satisfied.
2: Number & large particle ratio are satisfied.
3: Neither of 2 is satisfied.

In the above embodiments, a magnetic brush type developing method using a two component developer and a non-contact type developing method using one component developer are used, but this is not limiting. The effects of those embodiments are not dependent on the arrangements, methods, developer and structure of the developing device, and the order of the developments is determined by the amount of the fog developer particles in the white area of the surface of the image bearing member as described above.

In the foregoing description, the exemplary apparatus is provided with only two developing devices, but the present invention is applicable to the apparatus having three or more developing devices under the same concept.

In summary, according to those embodiments, the second developing device satisfies the following as compared with the first developing device:

1. The number of the fog developer particles per unit area is larger (preferably more than 1.5 times):
2. The ratio of the fog developer particles having large particle sizes to the entire fog developer particles is larger (particularly, the ratio of the fog developer particles having the particle sizes not less than 10 microns to the entire fog developer particles; further, the ratio of the fog developer particles having the particle sizes not less than 15 microns to the entire fog developer particles since the ratio greatly affects the separation property when they ambient conditions vary) (preferably more than 1.25 times):
3. The particle size at which the number of the fog developer particles accumulated in the large size side of a number/particle size distribution graph reaches 50% to the number of whole fog developer particles is larger; the particle size at which the number of the fog developer particles accumulated in the large size side of a number/particle size distribution graph reaches 10% to the number of whole fog developer particles is larger (this greatly affects a separation property when the ambient conditions vary) (preferably more than 1.5 times):
4. The ratio of the total area occupied by the fog developer particles to the entire white area is larger (preferably more than 1.5 times).

Of these, the top priority is given to Item 4, and the order of priority of the rest is Item 2, Item 3 and Item 1. However, if one of Items 1–4 is satisfied, the advantageous effects of the present invention can be provided.

According to those embodiments, the slight amount of fog developer particles deposited in the white area of the image bearing member when the toner image is formed by the second developing device is made larger than that of the first developing device, and therefore, when an image is to be added to the transfer material which has once been subjected to the image transfer, the improper separation and the image retransfer can be eliminated by a simple structure so that a conveyance of the transfer material can be assured, and the image quality can be improved.

Fifth embodiment will be described.

Figure 4:
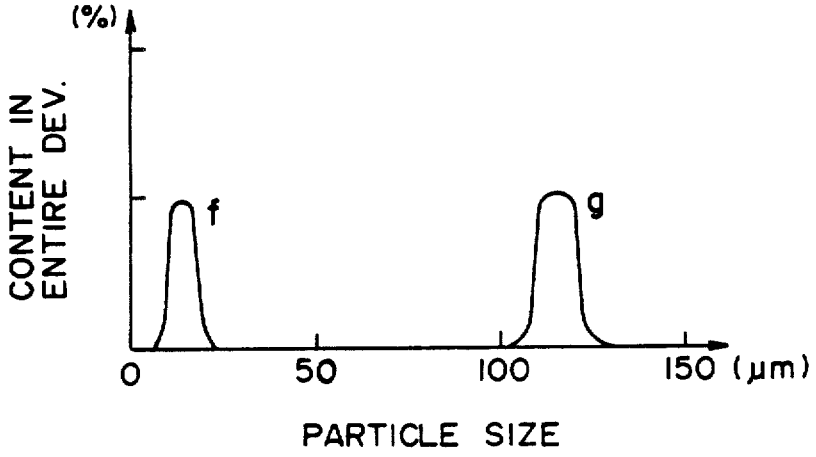
FIG. 4 is a graph showing a size distribution of the developer used in a second developing device.
Figure 5:
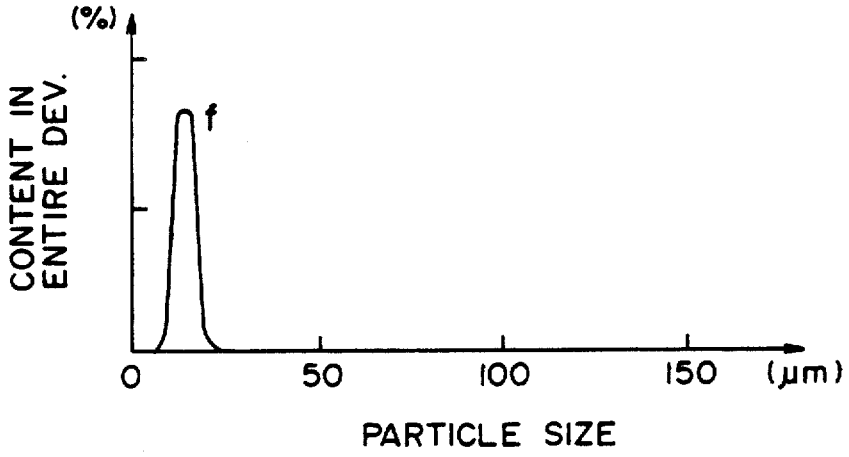
FIG. 5 is a graph showing a size distribution of the developer used in a first developing device.

The developing device 13 is a magnetic brush type developing device using two component developer containing carrier particles, whereas a developing device 14 is a non-contact type developing device using a one component developer not containing carrier particles. The particle size distribution of the developer used with the developing device 13 is as shown in FIG. 4, whereas that of the developing device 14 is as shown in FIG. 5. Since the developer in the developing device 13 contain carrier particles, the particle size distribution has two peaks, wherein one is a peak f for the toner particles, and the other is a peak g for the carrier particles. The maximum particle size of the developer is approximately 140 microns. On the other hand, the developer of the developing device 14 does not contain carrier particles having a large particle size, and therefore, the maximum particle size is at most 25 microns. In the image forming apparatus according to this embodiment, a toner image formed by the developing device 13 and the toner image formed by the developing device 14 are transferred onto one and the same transfer material through one copy cycle in the following sequence. A first electrostatic latent image is formed. Thereafter, a toner image is formed necessarily by the developing device 14 containing the developer having a smaller maximum particle size. After the first image transfer, separation and image fixing are completed, the second toner image is formed by the developing device 13 containing the developer having a larger maximum particle size, and then the second image transfer, separation and the image fixing are performed. In the first image transfer and the transfer material separating process, the transfer material 18 is not greatly curled, and therefore, the transfer material 18 can be easily separated without problem even if the toner image has been formed thereon by the developing device 14 containing only a relatively small particle size component. The problems of improper separation and/or the image retransfer do not occur. The formation of the second toner image after the transfer material 18 has been subjected to the first image fixing process which would result in a relatively large curl, is effected by the second developing device 13 containing carrier particles having a relatively large particle size. Therefore, even if the transfer material 18 is under the condition which is disadvantageous to the image transfer and the transfer material separation, can be easily separated without improper separation or retransfer of the image. The reason why the second separation is easy is that the white area of the toner image formed by the developing device 13 contains a small amount of carrier particles which have a very large particle size.

The developing device 14 which is the first developing device is not limited to the one component developer type, but may be a two component developer type. In this case, the amount of carrier particles deposited on the image bearing member by the first developing device 14 is smaller than that by the second developing device, i.e., the developing device 13. By this, the carrier deposition amount by the second developing device is relatively larger than that of the first developing device, whereby the separation can be stably performed, and the image retransfer can be prevented, even if the transfer material is curled.

In the foregoing example, one of the two developing devices is a magnetic brush type using a two component developer, and the other is a non-contact development type using a one component developer. However, both may be one of those types, or other type or types of developing method can be employed if the toner image is formed later by the developing device containing the developer having a larger maximum particle size. The foregoing explanation has been made with respect to the case of two developing devices being used. However, three or more developing devices may be employed under the concept of the present invention.

Further preferably, the developer of the second developing device has a larger carrier particle size than that of the first developing device, in addition to the above requirement of the deposition of the carrier particles.

As described in the foregoing, due to the above described difference in the amount of the carrier deposition, the transfer material separation is proper, and the image retransfer does not occur even if the transfer material is curled by the previous image fixing operation.

Referring back to FIG. 1, a further embodiment using the developing devices 13 and 14 and wherein an amount of triboelectric charge of toner is taken as the deposition parameter.

In this embodiment, the developing device 13 is a magnetic brush developing method utilizing two component developer containing a toner a carrier or the like, whereas the developing device 14 is a non-contact developing method utilizing one component developer not containing a carrier. An amount of the triboelectric charge of the toner contained in the developing device 13 is larger than the amount of the triboelectric charge of the toner contained in the developing device 14. The amount of the triboelectric charge of the toner on a developing roller 25 was measured, and that of the developing device 13 was 14 micro-C/gr, whereas that of the developing device 14 was 5 micro-C/gr. When in this apparatus a toner image formed by the developing device 13 and a toner image formed by the developing device 14 are to be transferred onto one and the same transfer material through one copying operation (superimposing or duplex mode), the image forming operation is executed in the following sequence. After the first latent image is formed, the first toner image is formed necessarily by the developing device 14 containing toner of which the electric charge is smaller; then, the toner image is transferred onto the transfer material, and the transfer material is separated from the image bearing member and is subjected to an image fixing operation; the second toner image is formed by the developing device 13 containing the toner of which the amount of charge is relatively large; then, the second image transfer, the second transfer material separation and the second image fixing are performed. In the first image transfer and transfer material supporting process, the transfer material 18 is not curled very much, and therefore, the image retransfer does not occur even if the toner image is formed by the second developing device 14 containing toner on which the amount of the electric charge is relatively small. Further, although the second image transfer and the transfer material separation process has to be performed to the transfer material 18 which has been relatively greatly curled by the first image fixing device, the second toner image is formed by the toner of which the amount of charge is relatively large, so that the image retransfer does not occur in the separation process even if the state of curling is disadvantageous to the separation process.

It has been found that an amount of charge of the toner particles supplied by the developing device 13 (the second developing device) for effecting superimposing or duplex recording to the transfer material which has been subjected to an image fixing operation is preferably larger than that of the toner of the first developing device and is not less than 10 micro-C/g from the standpoint of further preventing the image retransfer and improve the separating property In the foregoing description, the two developing devices are of magnetic brush developing type using a two component developer and non-contact developing type using a one component developer, respectively. However, this is not limiting, and the same advantageous effects are provided if the order of toner image formations is determined on the basis of the amounts of charge of the toner particles used with the developing devices. Also, in this embodiment, the structure wherein two developing devices are used is taken, but the number is not limited to two, and the same advantageous effects can be provided in the case of three or more developing devices used, if the order is determined under the above described concept.

The amount of charge of the toner particles is dependent on the actual structure of the developing device, so it is difficult to determine, but in order to increase the amount of the charge to satisfy the above described requirement, a blade for triboelectrification to the toner may be used; an external charge may be applied; an amount of charge assisting agent contained in the toner particles may be increased. Those methods are known, and therefore, one skilled in the art can make adjustment without difficulty.

As described in the foregoing, according to this embodiment, when the toner images formed by the two or more developing devices on one and the same transfer material are transferred, and the transfer material is separated and is subjected to the image fixing operation, the first toner image formation is effected by the developing device wherein the amount of electric charge of the toner is relatively small. Therefore, the image transfer and the transfer material separating process for the second and subsequent images can be performed without image retransfer despite the existence of the curling of the transfer material by the previous image fixing step. Those advantages are provided by a simple structure, that is, the order of the developing operations. Further, by making the two deposition parameters (amount of charge of the toner and amount of deposition of the carrier particles) larger in the developing device 13 than in the first developing device 14, the above described advantageous effects of the present invention can be stably maintained for a long period of time.

A further embodiment of the present invention will be described wherein two deposition parameters are selected to satisfy the respective requirements in the first and second developing devices. More particularly, in this embodiment, the first toner image is formed by a developing device by which the amount of fog developer particles deposited in the white area of the surface of the image bearing member is smaller and in which the amount of charge of the toner per unit weight is smaller. By doing so, the prevention of improper separation and image retransfer can be further stabilized.

The toner image formed on the image bearing member 10 surface by the developing device 13 (the second developing means) was observed by a microscope, and the fog developer particles per unit area in the white area was 390/mm$^2$. As for the developing device (the first developing means), it was 165/mm$^2$. It is apparent that the number of the fog developer particles is smaller in the first developing device 14 than in the second developing device 13. In addition, the electric charge of the toner per unit weight is smaller in the first developing device 14 than in the second developing device 13.

Table 6 shows the results of experiments regarding frequencies of occurrences of improper separation and image retransfer in a conventional apparatus wherein the toner image is first formed by the second developing device and an apparatus according to this embodiment (embodiment A) wherein the order is reversed.

TABLE 6

| | frequency of improper separation occurrences | frequency of retransfer occurrences |
|---|---|---|
| Embodiment A | 0% | 0% |
| Conventional | 0.6% | 51% |

The results prove that the effects of the present invention is enhanced when two or more deposition parameters are satisfied.

The amount of charge of the toner per unit weight was measured by the Faraday gauge method. In this method, an external cylinder made of metal and grounded is contacted to the surface of the image bearing member 10 having a toner image thereon to attract all the toner particles in a defined area on the image bearing member 10 surface, and the toner particles are collected by an internal cylindrical filter The weight of the toner collected is determined by the increase of the weight of the filter. Simultaneously, the amount of the charge accumulated on the internal cylinder made of a metal electrostatically shielded by the external cylinder is measured, so that the amount of charge of the toner attracted from the surface of the image bearing member 10 and corrected in the filter can be determined. The principle of this method is disclosed in, for example, DENSHISHASHIN GAKKAISHI, Vol. 11, No. 1.

A further embodiment will be described. The developing operation starts from a developing apparatus by which a ratio of fog developer particles having large particle sizes to the entire fog developer particles is smaller. The ratio is, for example, a ratio of fog developer particles having particle sizes larger than 10 microns to the entire fog developer particles in the white area. If necessary, the limit of 10 microns may be replaced with 15 microns, 20 microns or larger.

Table 7 shows the results of experiments regarding frequencies of occurrences of improper separation and image retransfer in a conventional apparatus wherein the toner image is first formed by a developing device by which the ratio of the fog developer particles having particle sizes larger than 10 microns to the entire fog developer particles in the white area is larger and in which the amount of the charge of the toner per unit weight is larger, and an apparatus according to the present embodiment wherein the order is reversed. In this case, the numbers of the fog developer particles per unit areas in the two apparatuses are comparable, more particularly, one of the numbers is not less than 0.5 but not more than 1.5 times the other number.

The ratios of the fog developer particles having particle sizes not less than 10 microns to the entire fog developer particles are 46% in the developing device 13 and 31% in the developing device 14.

TABLE 7

| | frequency of improper separation occurrences | frequency of retransfer occurrences |
|---|---|---|
| Embodiment B | 0% | 0% |
| Conventional | 1.1% | 62% |

The results prove that the effect of the present embodiment is significant.

Another method of discrimination will be described. In this method, a number/particle size distributions are first determined. And the particle size at which the number of the fog developer particles accumulated in the number/particle size distribution from the large size sides reaches a predetermined percentage (50% in this embodiment) to the number of whole fog developer particles, is determined. The developing operation starts from the developing device by which the thus determined particle size is smaller, and in which the amount of the charge of the toner per unit weight is smaller. The value of 50% is not limiting, and if necessary, it may be 30%, 20% or 10%.

Table 8 shows the results of experiments regarding frequencies of occurrences of improper separation and image retransfer in a conventional apparatus wherein the toner image is first formed by a developing device by which the particle size at which the number of the fog developer particles accumulated in the large size side of a number/particle size distribution graph reaches 10% to the number of whole fog developer particles was 15 microns and in which the amount of the charge of the toner per unit weight is larger, and then by the second developer wherein the particle size thus determined is 11 microns, and an apparatus according to this embodiment wherein the order is reversed.

TABLE 8

| | frequency of improper separation occurrences | frequency of retransfer occurrences |
|---|---|---|
| Embodiment C | 0% | 0% |
| Conventional | 0.9% | 60% |

The results prove that the effects of the present embodiment is significant.

The similar effects can be provided if the first developing operation is performed by the developing device in which the ratio of the total area occupied by the fog developer particles to the entire white area is smaller and wherein the amount of charge of the toner per unit weight is smaller.

In those embodiment, the magnetic brush type developing device using a two component developer and the non-contact type developing device using a one component developer are used. However, this is not limiting, and any developing method and developers can be used if the order of developing operation is determined on the basis of the amount of the fog developer particles deposited on the white area on the image bearing member surface and the amount of charge of the toner image per unit weight, the same effects can be provided. In those embodiments, two developing devices are employed. However, three or more developing devices may be used under the same concept with the same effects.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

means for forming first and second latent images on said image bearing member;

first developing means for developing the first latent image on said image bearing member into a first toner image;

second developing means for developing the second latent image on said image bearing member into a second toner image; and toner image processing means for transferring the first and second toner images from said image bearing member onto a transfer material, for separating the transfer material from said image bearing member by electric discharge, and for fixing the transferred toner images on the transfer material;

wherein the second latent image is formed on said image bearing member after the first toner image formed by said first developing means has been transferred to the transfer material, wherein the second toner image is transferred to the transfer material after the transfer material has received the first toner image, has been separated from said image bearing member, and has been subjected to the image fixing by said toner image processing means and wherein a developer of said second developing means has a toner deposition parameter which is larger than that of a developer of said first developing means.

2. An apparatus according to claim 1, wherein said deposition parameter is an amount of electric charge of toner particles of each of the developers of said first and second developing means.

3. An apparatus according to claim 1, wherein said deposition parameter is an amount of toner particles deposited in a background area of the latent image on said image bearing member.

4. An image forming apparatus, comprising;

an image bearing member;

means for forming first and second latent images on said image bearing member;

first developing means for developing the first latent image on said image bearing member into a first toner image;

second developing means for developing the second latent image on said image bearing member into a second toner image; and toner image processing means for transferring the first and second toner images from said image bearing member onto a transfer material, for separating the transfer material from said image bearing member by electric discharge, and for fixing the transferred toner images on the transfer material;

wherein the second latent image is formed on said image bearing member after the first toner image formed by said first developing means has been transferred to the transfer material, wherein the second toner image is transferred to the transfer material after the transfer material has received the first toner image, has been separated from said image bearing member, and has been subjected to the image fixing by said toner image processing means, and wherein an amount of carrier particles deposited on said image bearing member by said second developing means is larger than an amount of carrier particles deposited on said image bearing member by said first developing means.

5. An image forming apparatus, comprising:

an image bearing member;

means for forming first and second latent images on said image bearing member;

first developing means for developing the first latent image on said image bearing member into a first toner image;

second developing means for developing the second latent image on said image bearing member into a second toner image; and toner image processing means for electrostatically transferring the first and second toner images from said image bearing member onto a transfer material, for separating the transfer material by electric discharge from said image bearing member, and for fixing the transferred toner images on the transfer material;

wherein the second latent image is formed on said image bearing member after the first toner image formed by said first developing means has been transferred to the transfer material, wherein the second toner image is transferred to the transfer material after the transfer material has received the first toner image, has been separated from said image bearing member, and has been subjected to the image fixing by said toner image processing means and wherein an amount of fog in an area of said image bearing member corresponding to a background area caused by said second developing means is larger than that caused by said first developing means.

6. An apparatus according to claim 5, wherein the amount of fog is a number of developer particles per unit area constituting the fog.

7. An apparatus according to claim 5, wherein the amount of fog is a ratio of developer particles constituting the fog and having particle sizes not less than 10 microns to the entire developer particles constituting the fog.

8. An apparatus according to claim 5, wherein the amount of the fog is a ratio of developer particles constituting the fog and having particle sizes not less than 15 microns to the entire developer particles constituting the fog.

9. An apparatus according to claim 5, wherein an amount of the fog is a particle size at which a number of fog developer particles accumulated in the large size side of a number/particle size distribution graph reaches 50% to the entire number of fog developer particles.

10. An apparatus according to claim 5, wherein the amount of fog is a particle size at which a number of fog developer particles accumulated in the large size side of a number/particle size distribution graph reaches 10% to the entire number of fog developer particles.

11. An apparatus according to claim 5, wherein the amount of fog is a ratio of a total area occupied by developer particles constituting the fog to the entire background areas.

12. An image forming apparatus, comprising:

an image bearing member;

means for forming first and second latent images on said image bearing member;

first developing means for developing the first latent image on said image bearing member into a first toner image;

second developing means for developing the second latent image on said image bearing member into a second toner image; and toner image processing means for transferring the first and second toner images from said image bearing member onto a transfer material, for separating the transfer material from said image bearing member by electric discharge, and for fixing the transferred toner images on the transfer material;

wherein the second latent image is formed on said image bearing member after the first toner image formed by said first developing means has been transferred to the transfer material, wherein the second toner image is transferred to the transfer material after the transfer material has received the first toner image, has been separated from said image bearing member, and has been subjected to the imâge fixing by said toner image processing means and wherein an amount of charge of toner particles of a developer of said second developing means is larger than that of said first developing means.

13. An apparatus according to claim 12, wherein the amount of charge of the toner particles of said second developing means is not less than 10 micro-C/g.

14. An image forming apparatus, comprising:

an image bearing member;

means for forming first and second latent images on said image bearing member;

first developing means for developing the first latent image on said image bearing member into a first toner image;

second developing means for developing the second latent image on said image bearing member into a second toner image; and toner image processing means for transferring the first and second toner images from said image bearing member onto a transfer material, for separating the transfer material from said image bearing member by electric discharge, and for fixing the transferred toner images on the transfer material;

wherein the second latent image is formed on said image bearing member after the first toner image formed by said first developing means has been transferred to the transfer material, wherein the second toner image is transferred to the transfer material after the transfer material has received the first toner image, has been separated from said image bearing member, and has been subjected to the image fixing by said toner image processing means and wherein plural deposition parameters of a developer of said second developing means are larger than respective parameters of a developer of said first developing means.

15. An apparatus according to claim 14, wherein said deposition parameters are an amount of electric charge of toner particles of each of said first and second developing means and an amount of developer particles constituting fog in a background area of the latent image on said image bearing member.

* * * * *

UNITED STATES PATENT AND TRADEMARK OFFICE

CERTIFICATE OF CORRECTION

PATENT NO. : 4,992,831

DATED : February 12, 1991

INVENTOR(S) : TSUYOSHI KUNISHI

It is certified that error appears in the above-identified patent and that said Letters Patent is hereby corrected as shown below:

ON THE TITLE PAGE,
IN [57] ABSTRACT

Line 17, "entie number" should read --entire number--.

COLUMN 1

Line 45, "where after" should read --after which--.

COLUMN 3

Line 59, "fixing," should read --fixing--.
Line 65, "by" should be deleted.

COLUMN 4

Line 60, "image," should read --image--.

COLUMN 5

Line 28, "member" should read --member.--.
Line 44, "developing device 14 first" should read --developing device 14 (first--.

COLUMN 7

Line 44, "sides" should be deleted.

COLUMN 9

Line 42, "they" should read --the--.

UNITED STATES PATENT AND TRADEMARK OFFICE

CERTIFICATE OF CORRECTION

PATENT NO. : 4,992,831

DATED : February 12, 1991

INVENTOR(S) : TSUYOSHI KUNISHI

It is certified that error appears in the above-identified patent and that said Letters Patent is hereby corrected as shown below:

COLUMN 11

Line 44, "a" (second occurrence) should read --and--.

COLUMN 12

Line 26, "property" should read --property.--.

COLUMN 13

Line 48, "filter" should read --filter.--.

Signed and Sealed this

Fifth Day of January, 1993

*Attest:*

DOUGLAS B. COMER

*Attesting Officer*

*Acting Commissioner of Patents and Trademarks*